United States Patent [19]

Deutsch

[11] Patent Number: 4,713,997

[45] Date of Patent: Dec. 22, 1987

[54] DUAL MODE MUSICAL TONE GENERATOR USING STORED MUSICAL WAVEFORMS

[75] Inventor: Ralph Deutsch, Sherman Oaks, Calif.

[73] Assignee: Kawai Musical Instrument Mfg. Co., Ltd, Hamamatsu, Japan

[21] Appl. No.: 886,710

[22] Filed: Jul. 18, 1986

[51] Int. Cl.[4] ..... G10H 1/08; G10H 7/00

[52] U.S. Cl. ..... 84/1.22; 84/1.28

[58] Field of Search ..... 84/1.01, 1.22, 1.23, 84/1.28

[56] References Cited

U.S. PATENT DOCUMENTS 4,633,749 1/1987 Fujimori et al. ..... 84/1.01

*Primary Examiner*—Stanley J. Witkowski

*Attorney, Agent, or Firm*—Ralph Deutsch

[57] ABSTRACT

A keyboard operated musical instrument is disclosed in which dual musical tones are created by reading out data values stored in a waveshape memory. Waveshape data values are read out alternately by two memory addressing circuits. One memory addressing circuit addresses out waveshape data values at a constant memory address advance rate corresponding to the fundamental frequency of an actuated keyboard switch. The second memory addressing circuit addresses out waveshape data points at a time variant memory advance rate. The two sets of read out waveshape data values are combined to produce a dual musical tone.

13 Claims, 5 Drawing Figures

DUAL MODE MUSICAL TONE GENERATOR USING STORED MUSICAL WAVEFORMS

BACKGROUND OF THE INVENTION

1. Field of the Invention

This invention relates to musical tone synthesis and in particular is concerned with an improvement for producing several tone variations from stored musical waveforms.

2. Description of the Prior Art

The most obvious method to imitate an acoustic musical instrument is to record the sound and to replay the recording in response to an actuated keyswitch on an array of keyswitches. While at first thought the straightforward technique of recording and keyed playback seems to be attractive, a practical realization of such a musical instrument can be burdened by a large amount of memory required to store the recorded data. The maximum amount of memory is associated with a tone generation system that uses a separate and distinct recording for each note played in the range of the musical instrument's keyboard. Some economy in the memory requirement has been made by using a single recording for several contiguous musical notes. This economy is based upon the tacit assumption that the waveshape for the imitated acoustic musical instrument does not change markedly between several contiguous successive notes.

Electronic musical tone generators that operate by playing back recorded musical waveshapes stored in a binary digital data format have been given the generic name of PCM (Pulse Code Modulation). A musical instrument of the PCM type is described in U.S. Pat. No. 4,383,462 entitled "Electronic Musical Instrument." In the system described in the patent, the complete waveshape of a musical tone is stored for the attack and decay portions of the musical tone. A second memory is used to store the remainder of the tone which comprises the release phase of the musical tone. The sustain phase of the musical tone is obtained by using a third memory which stores only points for a single period of a waveshape. After the end of the decay phase, the data stored in the third memory is read out repetitively and the output data is multiplied by an envelope function generator to create the amplitude variation for the sustain and release portions of the generated musical tone.

Because of the large amount of memory required for a stored waveform PCM musical tone generation system, it is desirable to employ techniques which use a single stored waveform to generate more than one musical tone. It is an object of the present invention to produce several different musical tones from a single stored waveshape.

SUMMARY OF THE INVENTION

In a musical tone generator of the type in which the musical tone is generated by reading out stored waveshape data points a dual musical tone is generated from a single stored set of waveshape data points. Waveshape data values are read out alternately by two memory addressing circuits. The first memory address circuit reads out waveshape data values at a constant memory address rate which is determined by the fundamental frequency associated with a keyboard switch to which a tone generator has been assigned. The second memory address circuit reads out waveshape data values at a time variant memory advance rate. The two sets of read out waveshape data values are combined into a single sequence of data values which are converted into an analog signal which provides the dual musical tone. The combination of the two sets of data values can be either a simple pointwise summation or a pointwise multiplication of data values.

BRIEF DESCRIPTION OF THE DRAWINGS

The detailed description of the invention is made with reference to the accompanying drawings.

FIG. 3 is a schematic diagram of a second alternate embodiment of the invention.

DETAILED DESCRIPTION OF THE INVENTION

The present invention is directed toward a musical tone generator in which a musical waveshape is stored in a memory.

Figure 1:
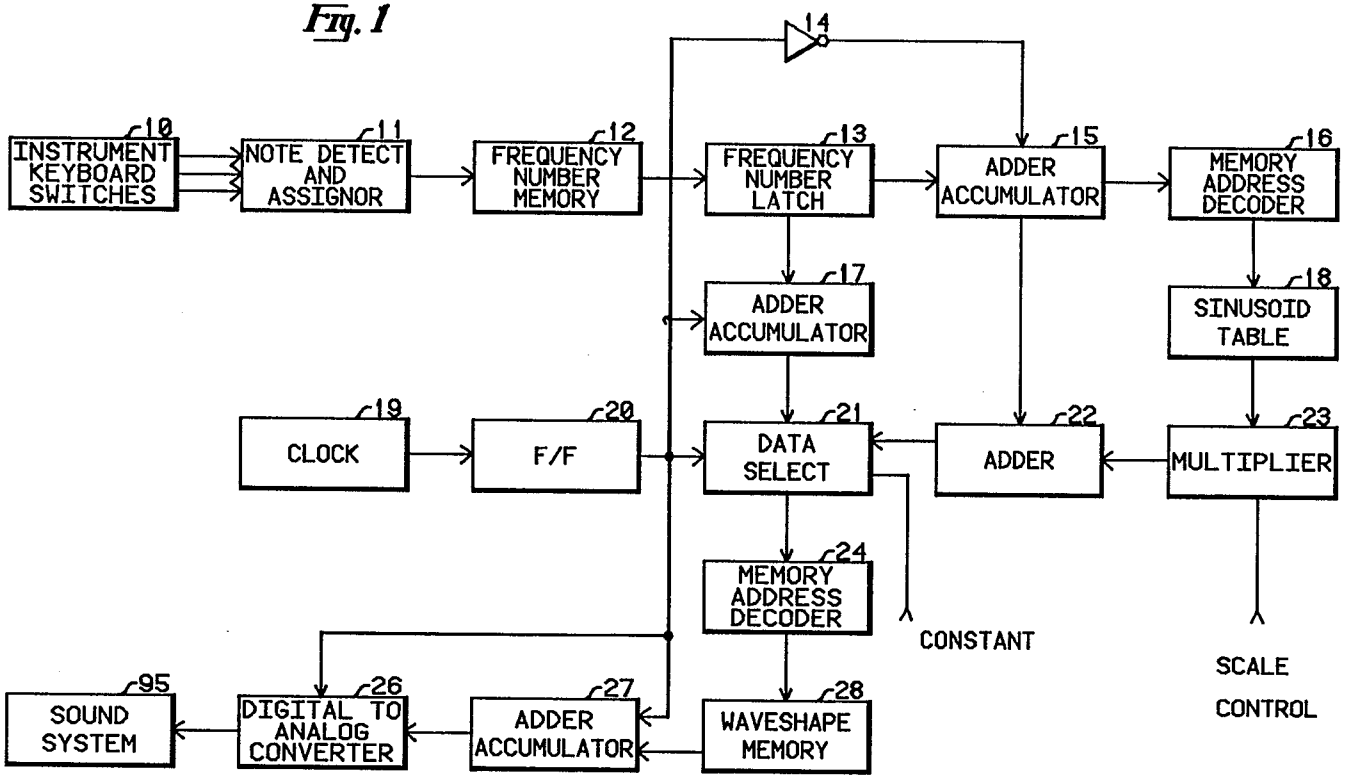
FIG. 1 is a schematic diagram of an embodiment of the invention showing the details of one of the tone generators.
Figure 5:
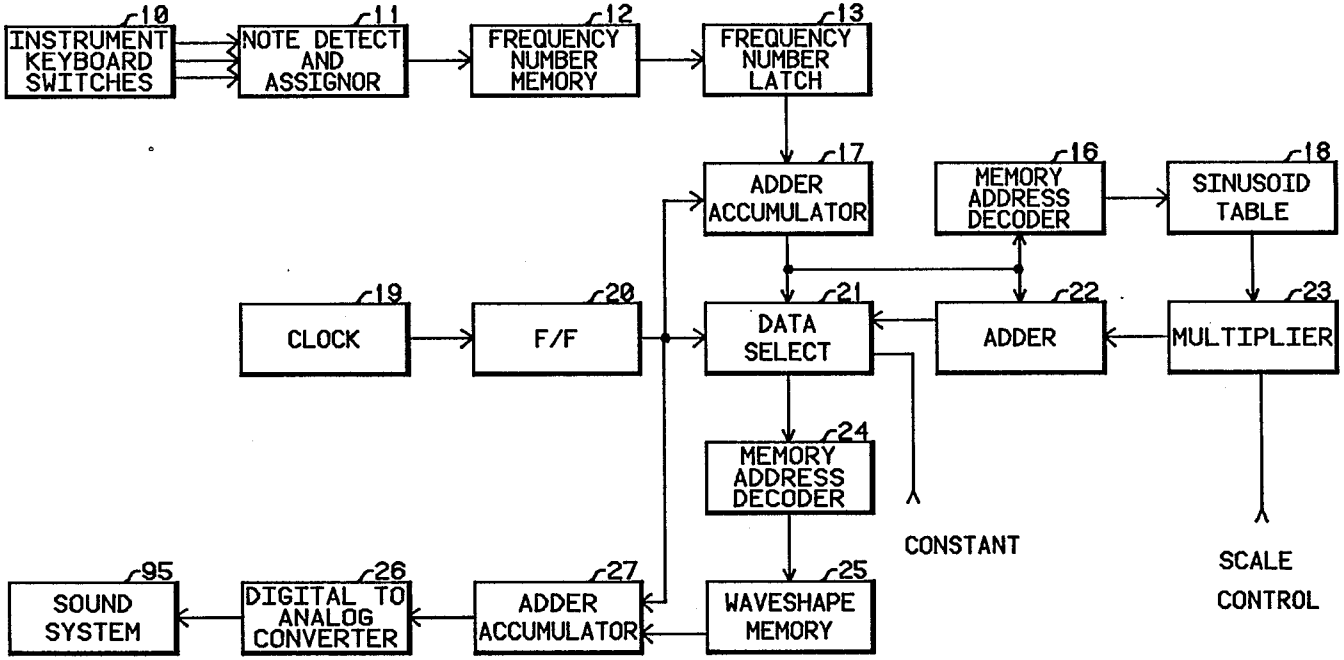
FIG. 5 is a schematic diagram of an embodiment of the invention.

FIG. 5 illustrates an embodiment of the present invention as incorporated into a keyboard operated electronic musical instrument. FIG. 1 illustrates an embodiment of the invention showing details of one of the tone generators contained in the system box of FIG. 5 labelled tone generators 100. The keyboard switches are contained in the system logic block labeled instrument keyboard switches 10. If one or more of the keyboard switches has a switch status change and is actuated ("on" switch position), the note detect and assignor 11 encodes the detected keyboard switch having the status change to an actuated state and stores the corresponding note information in a memory which is contained in the note detect and assignor 11. A tone generator is assigned to each actuated keyswitch using the encoded detection data generated by and stored in the note detect and assignor 11.

A suitable configuration for a note detect and assignor subsystem is described in U.S. Pat. No. 4,022,098 entitled "Keyboard Switch Detect And Assignor." This patent is hereby incorporated by reference.

FIG. 1 only explicitly shows a single tone generator. The representative tone generator is comprised of all the illustrative system blocks except for blocks 10 and 11. The other tone generators are simply duplicates of the same system blocks.

When the note detect and assignor 11 finds that a keyboard switch has a switch status change to an actuated switch state, a frequency number corresponding to the actuated keyswitch is read from the frequency number memory 12 in response to the encoded detection information stored in the note detect and assignor 11. The frequency number memory 12 can be implemented as a read-only addressable memory (ROM) containing data words stored in binary numeric format having values $2^{(N-M)/12}$ where N has the range of values $N=1,2,\ldots,M$ and M is equal to the number of keyswitches on the musical instrument's keyboard. N designates the number of a keyswitch. These switches are numbered consecutively from "1" at the lowest keyboard switch. The frequency numbers represent the ratios of frequencies of generated musical tones with respect to the frequency of the system's logic clock. A detailed description of frequency numbers is contained in U.S. Pat. No. 4,114,496 entitled "Note Frequency Generator For A Polyphonic Tone Synthesizer." This patent is hereby incorporated by reference.

The frequency number read out of the frequency number memory 12 is stored in the frequency number latch 13.

The clock 19 provides a sequence of timing signals. The timing signals are transformed into a square waves by means of the flip-flop 20.

In response to the start of the positive half of the square wave generated by the flip-flop 20, the frequency number stored in the frequency number latch is successively added to the content of an accumulator contained in the adder-accumulator 17. The content of this accumulator is called the accumulated sum of a frequency number. Since the frequency number is less than or equal to "one", the accumulated frequency number will consist of an integer portion and a decimal portion separated by the radix point.

In response to the positive half of the square wave generated by the flip-flop 20, the data select 21 transfers the integer portion of the accumulated sum of a frequency number from the adder-accumulator 17 to the memory address decoder 24. The memory address decoder 24 reads out a stored waveshape data point from the waveshape memory 28 in response to the address data transferred by the data select 21.

The content of the accumulator in the adder-accumulator 27 is reset to a zero value each time that the square wave generated by the flip-flop 20 starts its positive half period. The content of this accumulator is transferred to the digital-to-analog converter before the accumulator is reinitialized to a zero value.

The digital-to-analog converter 26 converts the sequence of data values provided by the adder-accumulator into an analog signal. This analog signal is transformed into an audible musical sound by means of the sound system 95. The sound system 95 consists of a conventional amplifier and speaker combination.

The inverter 14 inverts the states of the square wave generated by the flip-flop 20. Thus the adder-accumulator 15 will successively add the frequency number stored in the frequency number latch 13 to the content of an accumulator contained in the adder-accumulator 15 in response to the start of the negative half-period of the square wave generated by the flip-flop 20. The content of this accumulator is the accumulated sum of a frequency number.

A prespecified number of bits to the left of the radix point of the accumulated frequency number contained in the adder-accumulator 15 is transferred to the memory address decoder 16. A variety of different musical tones can be generated by varying the number bits of the data word from the accumulated frequency number which is transferred to the memory address decoder 16.

The memory address decoder 16 reads out trigonometric sine values from the sinusoid table 16 in response to the selected portion of the accumulated frequency number transferred from the adder-accumulator 15.

The trigonometric sine values read out from the sinusoid table 18 are scaled in magnitude by the multiplier 23 in response to the scale control signal. This scaling in magnitude, which can be a function of time, provides an additional control on the spectral content of the generated musical tone.

The adder 22 forms the sum of the scaled data produced by the multiplier 23 and the accumulated frequency number contained in the adder-accumulator 15.

The data word read out from the waveshape memory 28 during the negative portion of the square wave generated by the flip-flop 20 is added to the data word read out from the waveshape memory 28 during the positive portion of this square wave by means of the adder-accumulator 27. The summed data is converted into an audible musical sound by means of the combination of the digital-to-analog converter 26 and the sound system 95.

The data select 21 is implemented to respond to a CONSTANT control signal. If the CONSTANT signal has a "0", then the system operates in the manner already described. If the CONSTANT signal has a value of "1", the data select 21 inhibits the data values produced by the adder 22 and the system operates in the conventional manner of a tone generation system employing a stored musical waveform. If the CONSTANT signal has a value of "2", the output data from the adder-accumulator 17 is inhibited and only the data produced by the adder 22 is transferred to the memory address decoder 24.

Figure 2:
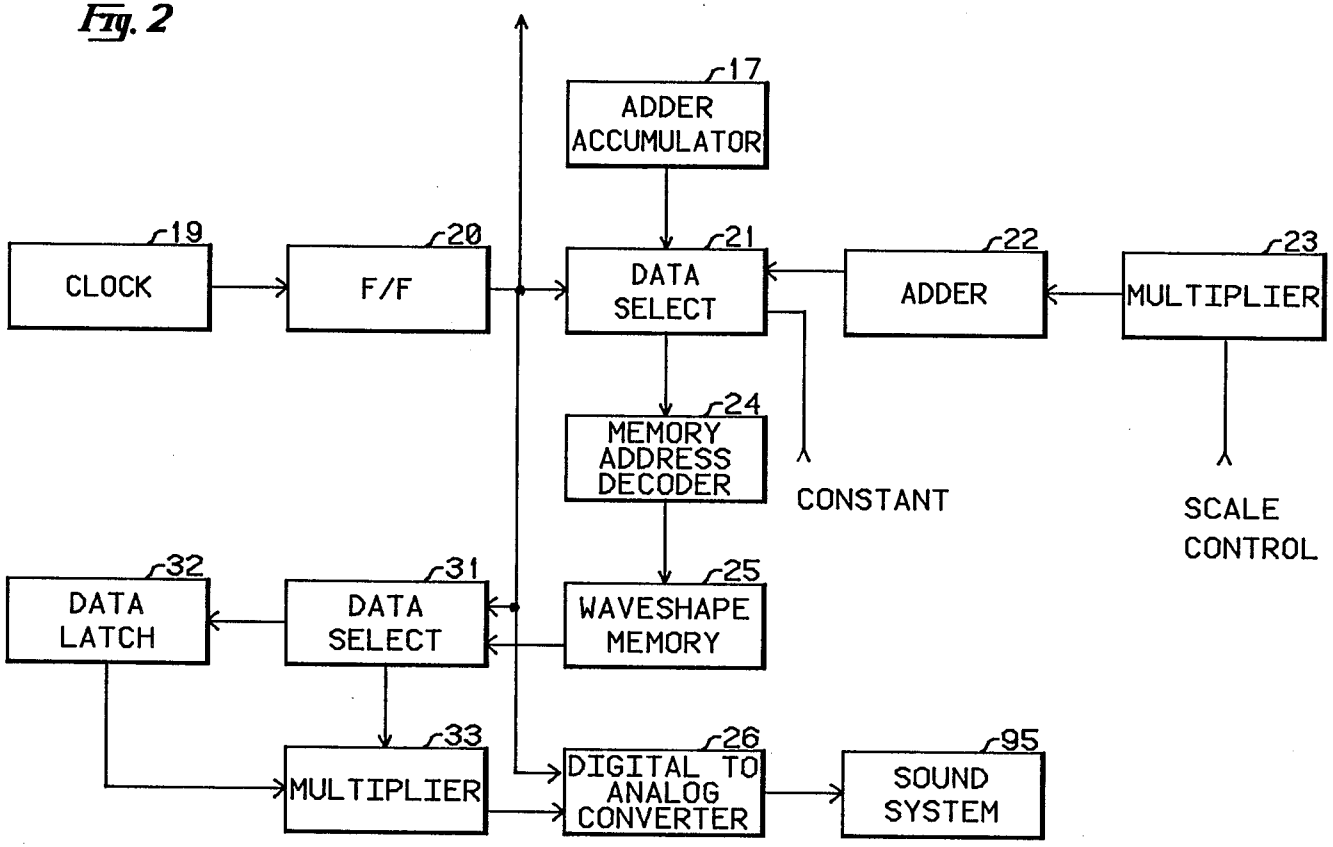
FIG. 2 is a schematic diagram of a first alternate embodiment of the invention.

An alternate embodiment of the invention is shown in FIG. 2. In the system shown in FIG. 1 and previously described, the successive waveshape sample points read out from the waveshape memory 25 during both halves of the square wave produced by the flip-flop 20 are pointwise added linearly to each other. In the system shown in FIG. 2, the corresponding sample points are multiplied pointwise. This multiplication is a form of waveshape modulation which produces spectral components in the output musical sound which are not present in the original stored waveshape or that produced by the combination subsystems shown in FIG. 1.

In response to the positive portion of the square wave generated by the flip-flop 20, the data point read out from the waveshape memory 25 is transferred by the data select 31 and stored in the data latch 32. In response to the negative portion of this square wave, the data point read out of the waveshape memory 25 is transferred via the data select 31 to the multiplier 33. The multiplier 33 multiplies the previous data point stored in the data latch 33 by the current data point transferred by the data select 31. The product values are transmitted to the digital-to-analog converter 26.

A second alternative implementation of the invention is shown in FIG. 3. In the system shown in FIG. 3 the adder-accumulator 15 and the phase inverter 14, used in the system shown in FIG. 1, are eliminated. The memory address decoder 16 uses only a preselected number of bits to the left of the radix point of the accumulated frequency number contained in the adder-accumulator 17 to address out trigonometric sinusoid function values from the sinusoid table 18.

The adder-accumulator 27 shown in FIG. 3 operates in a fashion similar to the same block for the system shown in FIG. 1. This action has been previously described. Another variation is to replace the adder-accumulator 27 shown in FIG. 3 by the combination of the data select 31, the data latch 32, and the multiplier 33 shown in FIG. 2.

Figure 4:
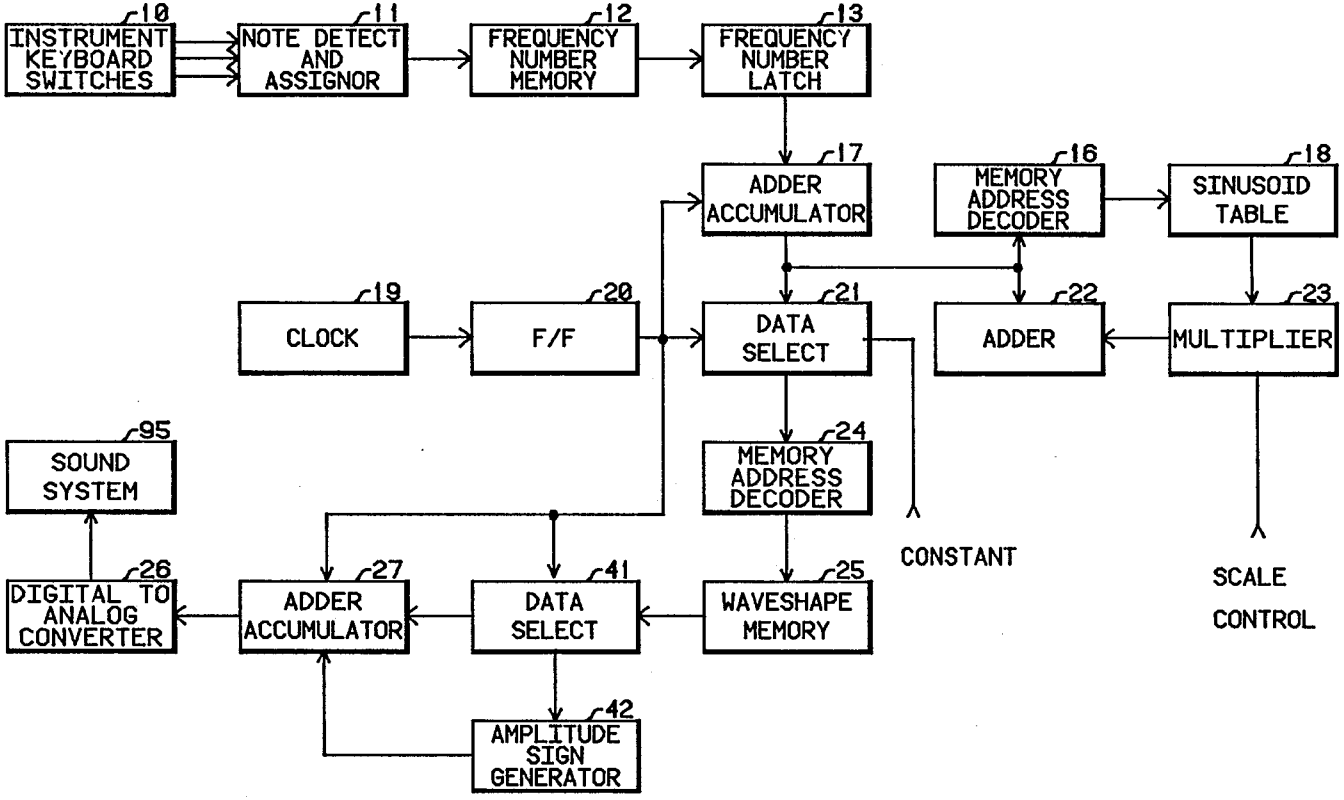
FIG. 4 is a schematic diagram of a third alternate embodiment of the invention.
Figure 5:
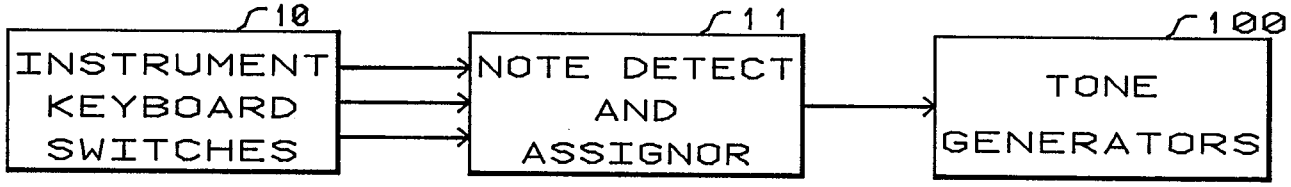

FIG. 4 shows another embodiment of the present invention. In this embodiment of the system, the waveshape corresponding to the phase modulated tone is converted into a purely "zero-crossing" waveshape. In this fashion a very bright tone having a large number of overtones is generated and the addition of the original waveshape yields a combination tone that does not have any undesirable pronounced spectral nulls.

The system operation and signal flow for the system shown in FIG. 4 is identical to the system shown in FIG. 3 until the signals reach the data select 41.

The data select 41 alternately transmits a waveshape data point read out from the waveshape memory 25 first to the adder-accumulator 27 and then to the amplitude sign generator 42.

The amplitude sign generator 42 can be implemented as a digital data comparator. A "1" logic state signal is transmitted to the adder-accumulator 17 by the amplitude sign generator if the waveshape data point furnished by the data select 41 has a positive or zero value. A "−1" signal is furnished by the amplitude sign generator 42 if the waveshape data point furnished by the data select 41 has a negative value.

I claim:

1. In combination with a keyboard operated musical instrument having an array of keyswitches, apparatus for producing a dual musical tone comprising;

an assignor means whereby a detect data word is generated in response to each actuated keyswitch in said array of keyswitches and one of a plurality of tone generators is assigned to each actuated keyswitch and whereby a corresponding detect data word is provided to the corresponding said assigned tone generator; and said plurality of tone generators each of which comprises, a frequency number generator means whereby, a frequency number is generated corresponding to said detect data word provided to said corresponding assigned tone generator, a waveshape memory for storing a preselected set of waveshape data words, a memory addressing means whereby said preselected set of waveshape data words are read out sequentially from said waveshape memory at a memory address advance rate response to said generated frequency number, a dual memory addressing means whereby said preselected set of waveshape data words are read out sequentially from said waveshape memory at a time variant memory advance rate, a select means for selectively reading out waveshape data words from said waveshape memory alternately in response to said memory addressing means and in response to said dual memory addressing means, a combination means for combining waveshape data words read out from said waveshape memory by said memory addressing means and by said dual memory addressing means to form a sequence of composite waveshape data words, and a conversion means for producing said dual musical tone responsive to said sequence of composite waveshape data words.

2. In a musical instrument according to claim 1 wherein said memory addressing means comprises, a timing clock for providing timing signals, and an adder-accumulator means, comprising an accumulator for successively adding said generated frequency number in response to said timing signals to the contents of said accumulator to produce an accumulated frequency number.

3. In a musical instrument according to claim 2 wherein said dual memory addressing means comprises;

a dual adder-accumulator means, comprising an accumulator, whereby in response to said timing signals said generated frequency number is successively added to the contents of said accumulator to produce a dual accumulated frequency number, and a time scaling means whereby said dual accumulated frequency number is chanaged in magnitude in a time variant fashion to form a time variant accumulated frequency number.

4. In a musical instrument according to claim 3 wherein said select means comprises;

a clock select means whereby alternate timing signals provided by said timing clock are selected to provide a first sequence of timing signals and to provide a second sequence of timing signals, and a waveshape memory addressing means for alternately reading out a first waveshape data point from said waveshape memory in response to said first sequence of timing signals and said accumulated frequency number and for reading out a second waveshape data point from said waveshape memory in response to said second sequence of timing signals and said time variant accumulated frequency number.

5. In a musical instrument according to claim 3 wherein said time scaling means comprises;

a sinusoid table storing a set of trigonometric function values, a sinusoid table addressing means responsive to said dual accumulated frequency number for reading out a trigonometric function value from said sinusoid table, a multiplier whereby said trigonometric function value read out from said sinusoid table is multiplied by a preselected multiplier value, and an adder for summing the output value from said multiplier with said dual accumulated frequency number to create said time variant accumulated frequency number.

6. In a musical instrument according to claim 1 wherein said combination means comprises;

a means for summing waveshape data words read out from a waveshape memory by said memory addressing means and said dual memory addressing means to form said sequence of composite waveshape data words.

7. In a musical instrument according to claim 1 wherein said combination means comprises;

a means for multiplying waveshape data words read out from a waveshape memory in response to said memory addressing means by waveshape data words read out from said waveshape memory in response to said dual memory addressing means to form said sequence of composite waveshape data words.

8. In a musical insrument according to claim 2 wherein said dual memory addressing means comprises;

a sinusoid table storing a set of trigonometric values, a sinusoid table addressing means responsive to said accumulated frequency number for reading out a trigonometric function value from said sinusoid table, a multiplier whereby said trigonometric function value read out from said sinusoid table is multiplied by a preselected multiplier value, and an adder for summing the output value from said multiplier with said accumulated frequency number to create a time variant accumulated frequency number.

9. In combination with a keyboard operated musical instrument having an array of keyswitches, apparatus for producing a dual musical tone comprising;

an assignor means whereby a detect data word is generated in response to each actuated keyswitch in said array of keyswitches and one of a plurality of tone generators is assigned to each actuated keyswitch and whereby a corrresponding detect data word is provided to the corresponding said assigned tone generator; and said plurality of tone generators each of which comprises, a frequency number generating means whereby a frequency number is generated corresponding to said provided detect data word, a waveshape memory for storing a preselected set of waveshape data words, a memory addressing means whereby said preselected set of waveshape data words are read out sequentially from said waveshape memory at a memory address advance rate responsive to said generated frequency number, a dual memory addressing means whereby said preselected set of waveshape data words are read out sequentially from said waveshape memory at a time variant memory advance rate responsive to said generated frequency number, a select means for reading out waveshape data words from said waveshape memory alternately in response to said memory addressing means and in response to said dual memory addressing means, a waveshape data word transform means whereby said waveshape data words read out of said waveshape memory by said dual memory addressing means are altered to form a sequence of transformed waveshape data words, a combination means for combining waveshape words read out from said waveshape memory by said memory addressing means with said sequence of transformed waveshape data words to form a sequence of composite waveshape data words, and a conversion means for producing said dual musical tone responsive to said sequence of composite waveshape data words.

10. In a musical instrument according to claim 9 wherein said memory addressing means comprises;

a timing clock for providing timing signals, and an adder-accumulator means, comprising an accumulator, wherein in response to said timing signals said generated frequency number is successively added to the content of said accumulator to produce an accumulated frequency number.

11. In a musical instrument according to claim 10 wherein said select means comprises;

a clock select means whereby alternate timing signals provided by said timing clock are selected to provide a first sequence of timing signals and to provide a second sequence of timing signals, and a waveshape memory addressing means for alternately reading out a first waveshape data word from said associated waveshape memory in response to said first sequence of timing signals and said accumulated frequency number and for reading out a second waveshape data word from said associated waveshape memory in response to said second sequence of timing signals and said timing variant memory advance rate.

12. In a musical instrument according to claim 10 wherein said dual memory addressing means comprises;

a sinusoid table storing a set of trigonometric function values, a sinusoid table addressing means responsive to said accumulated frequency number for reading out a trigonometric function value from said sinusoid table, a multiplier whereby said trigonometric function value read out from said sinusoid table is multiplied by a preselected multiplier value, and an adder for summing the output value from said multiplier with said accumulated frequency number to create said time variant memory advance rate.

13. In a musical instrument according to claim 9 wherein said waveshape data transform means comprises;

a comparator means whereby a data word in said sequence of transformed waveshape data words is generated with a unit positive numerical value if a waveshape data word read out of said waveshape memory by said dual memory addressing means has a positive or zero numerical value and whereby a data word in said sequence of transformed waveshape data words is generated with a unit negative numerical value if a waveshape data word read out of said waveshape memory by said dual memory addressing means has a negative numerical value.

* * * * *